United States Patent [19]

Ahrns et al.

[11] 4,398,525

[45] Aug. 16, 1983

[54] MULTI-STAGE EXHAUST GAS RECIRCULATION SYSTEM

[75] Inventors: Daniel C. Ahrns, Livonia; Shane H. Rachedi, Dearborn, both of Mich.

[73] Assignee: Ford Motor Company, Dearborn, Mich.

[21] Appl. No.: 320,249

[22] Filed: Nov. 12, 1981

[51] Int. Cl.[3] ..... F02M 25/06

[52] U.S. Cl. ..... 123/568; 123/589

[58] Field of Search ..... 123/568, 569

[56] References Cited

U.S. PATENT DOCUMENTS

| | | | |
|---|---|---|---|
| 3,641,989 | 2/1972 | Hill | 123/568 |
| 3,799,131 | 3/1974 | Bulton | 123/568 |
| 3,834,366 | 9/1974 | Kingsbury | 123/568 |
| 3,880,129 | 4/1975 | Hollis, Jr. | 123/568 |
| 4,128,090 | 12/1978 | Aoyama | 123/568 |
| 4,130,093 | 12/1978 | Aoyama | 123/568 |
| 4,178,896 | 12/1979 | Horikoshi et al. | 123/568 |
| 4,180,034 | 12/1979 | Vogelsberg | 123/568 |
| 4,186,698 | 2/1980 | Aoyama | 123/568 |
| 4,248,186 | 2/1981 | Yamada | 123/568 |

*Primary Examiner*—Wendell E. Burns

*Attorney, Agent, or Firm*—Robert E. McCollum; Clifford L. Sadler

[57] ABSTRACT

An automotive type exhaust gas recirculation (EGR) system has two modes of operation, a first one that regulates EGR flow at a constant percentage rate as a function of throttle valve position independently of exhaust gas backpressure changes, and a second one that provides a variable percentage rate of flow of EGR gases in response to changes in exhaust gas backpressures, both modes utilizing carburetor ported vacuum modified by an air bleed device as the EGR valve opening force.

7 Claims, 3 Drawing Figures

MULTI-STAGE EXHAUST GAS RECIRCULATION SYSTEM

Figure 1:
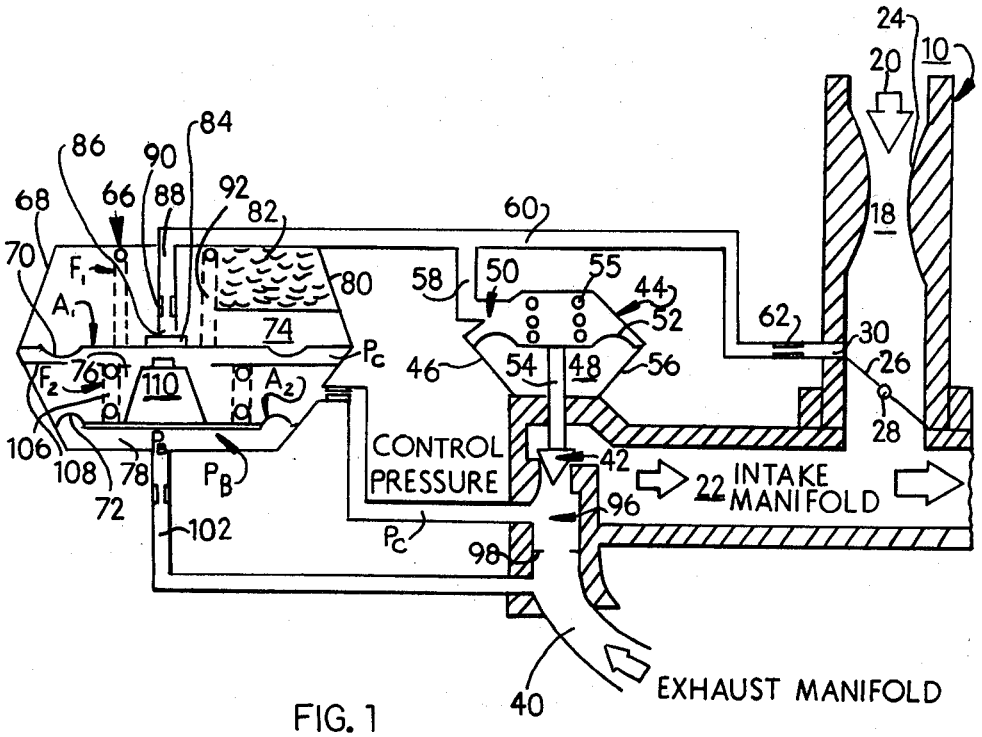

This invention relates in general to an exhaust gas recirculation (EGR) system for an automotive type internal combustion engine. More particularly, it relates to one having two stages of operation providing varying percentage rates of flow of the EGR gases.

A common type of EGR system in use today is of the so called backpressure control type. It operates on the principle of establishing a constant pressure chamber in the exhaust manifold passage immediately upstream of the EGR valve. The movement of the EGR valve is regulated in accordance with changes in exhaust gas backpressure to maintain the chamber pressure constant by variably bleeding air into the control vacuum that is used to actuate the EGR valve to its various positions. The EGR valve and bleed valve oscillate back and forth for each control vacuum level change until the pressure in the control chamber is returned to the constant value. The rate of EGR flow through the valve, therefore, is a constant percentage up to the flow capacity of the chamber. Examples of such systems are shown and described in U.S. Pat. No. 3,799,131, Bolton; U.S. Pat. No. 3,880,129, Hollis; U.S. Pat. No. 3,834,366, Kingsbury; and U.S. Pat. No. 4,178,896, Horikoski et al.

Another common type of EGR system uses carburetor venturi vacuum in addition to the constant pressure chamber to control movement of the air bleed valve. This provides an EGR percentage rate of flow that is more proportional to the air intake flow through the engine than the first described type. Examples of this latter type are shown in U.S. Pat. No. 4,130,093, Aoyama; U.S. Pat. No. 4,248,186, Yamada; and U.S. Pat. No. 4,186,698 (FIG. 2) Aoyama. Again, the EGR valves of these patents provide only a single stage flow of EGR gases.

The use of a control vacuum per se for actuation of the EGR valve, in general is known. For example, see U.S. Pat. No. 3,641,989, Hill, which shows in FIG. 3 a carburetor ported vacuum actuated EGR valve.

This invention provides an EGR construction that combines the advantageous features of the above-known EGR systems. It has a dual stage of operation providing varying percentage rates of flow of the EGR gases. An air bleed device controls the level of the EGR valve opening control vacuum, a constant pressure control chamber controlling operation of the air bleed device at low backpressure levels. Additional backpressure sensitive means in the air bleed device controls the operation at higher backpressure levels to provide a variable percentage rate of flow of EGR gases.

It is a primary object of the invention, therefore, to provide a multi-stage EGR system utilizing first a constant pressure control chamber upstream of the EGR valve in cooperation with an air bleed device to establish a first constant percentage rate of gas flow through the EGR valve below predetermined pressure levels in the exhaust manifold; and, secondly, utilizing an exhaust backpressure sensitive member in cooperation with the air bleed device operative above the predetermined backpressure levels to establish a variable percentage rate of gas flow as a function of the changes in exhaust gas backpressure levels.

EGR systems utilizing both a constant pressure control chamber upstream of the EGR valve and the application of the pressure in the exhaust manifold to an air bleed transducer are known. For example, U.S. Pat. No. 4,128,090, Aoyama, shows in FIG. 2 an air bleed transducer 25 that is responsive to the pressure in a control pressure chamber upstream of the EGR valve 23 and also responsive to the pressure immediately upstream of an orifice 24 in the exhaust manifold pipe, to modify the manifold vacuum acting to move the EGR valve to its open positions. However, this is still but a single stage EGR system with a variable percentage rate of flow of gases through the EGR valve at all times.

U.S. Pat. No. 4,180,034, Vogelsberg, does show an EGR valve assembly providing two different percentage rates of flow of exhaust gas through the EGR valve depending upon the location of the stem of the EGR valve relative to the orifice 20 defining the constant pressure control chamber upstream of EGR valve 24. However, the devices does not provide the two separate stage operation of the invention combining the features of both the backpressure constant control chamber type EGR system and the engine air flow proportional type EGR system.

U.S. Pat. No. 4,186,698, Aoyama shows in FIG. 2 an EGR system that utilizes venturi vacuum as well as the pressure differential across an orifice in the exhaust manifold to modify a carburetor ported control vacuum signal that is connected both to the EGR valve and to an air bleed device. However, again, there is no separate staged operation providing a first EGR percentage rate of flow that is responsive solely to a constant pressure control chamber pressure level followed by a second variable pressure range of operation responsive to higher exhaust manifold pressure levels to establish a different percentage rate of flow that is more proportional to the flow of engine intake air.

Figure 2:
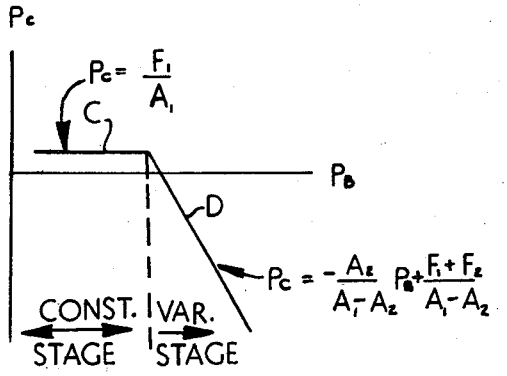
Figure 3:
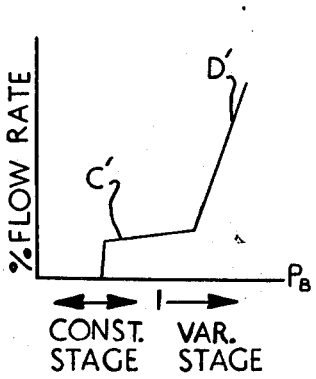

Other objects, features and advantages of the invention will become more apparent upon reference to the succeeding detailed description thereof, and to the drawings illustrating the preferred embodiment thereof; wherein, FIG. 1 schematically represents an EGR system embodying the invention, with parts broken away and in section; and, FIGS. 2 and 3 graphically illustrate changes in the pressures and percentage flow rate, respectively, with respect to various components of the system illustrated in FIG. 1.

FIG. 1 schematically illustrates an EGR system including a portion 10 of a downdraft type two-barrel carburetor. It has the usual air/fuel induction passage 18 open at its upper end 20 to fresh air from an air cleaner, not shown, and is connected at its lower end to the engine intake manifold 22. A fixed area venturi 24 cooperates with a boost venturi, not shown, through which the main supply of fuel is induced, by means also not shown.

Flow of air and fuel through induction passage 18 is controlled by a throttle valve plate 26 fixed on a shaft 28 rotatably mounted in the side walls of the carburetor body.

The induction passage 18 contains a pressure sensing port 30; which, in this case is identified as EGR vacuum sensing port 30. The port is adjacent the throttle valve 26 in its closed position to be traversed by the edge as the throttle valve moves to open positions. This progressively exposes port 30 to the level of the vacuum in manifold 22, and thus provides a ported vacuum level that varies as a function of throttle valve position.

The exhaust manifolding part of the engine cylinder head includes an exhaust gas crossover passage, not shown. The latter passes from the exhaust manifold on one side of the engine to the opposite side beneath the intake manifold to provide the usual "hot spot" beneath the carburetor to better vaporize the air/fuel mixture. Connected to the crossover passage is a branch EGR passage 40 that is interconnected to the intake manifold passage 22, as shown.

To control the recirculation of exhaust gases into the engine, passage 40 is adapted to be closed by an EGR valve 42 that is moved to an open position by a servo means 44. Servo 44 includes a hollow casing or shell 46. It is partitioned into an air chamber 48 and a vacuum chamber 50 by an annular flexible diaphragm 52. The EGR valve 42 is connected to diaphragm 52 by a stem 54 for movement therewith, and is biased to a closed position by a spring 55. The air chamber 48 is connected to ambient air by a vent or hole 56 in shell 46. The vacuum chamber 40 is connected by a passage 58 and connecting passage 60 to EGR port 30. The latter contains a flow restrictor 62 that regulates the bleed rate in the passage. EGR valve 42, therefore, is moved to an open position as a function in the changes in the vacuum level in passage 60 as determined by the position of the throttle valve or plate 26.

The level of vacuum in passage 60 leading to servo 44 is controlled by an air bleed pressure regulating device or transducer 66. The latter consists of a hollow shell 68 containing two spaced annular flexible diaphragms 70 and 72 of areas $A_1$ and $A_2$, respectively, that subdivide the shell into a number of chambers 74, 76 and 78. Chamber 74 is connected to ambient air at essentially atmospheric pressure through an opening 80 containing an air filter 82. Chamber 74 constitutes a pressure regulating chamber. It includes a disc-type bleed valve 84 fixed to one side of diaphragm 70 and cooperating with the open air vent end 86 of a stand pipe 88 connected to vacuum line 60. An orifice or flow restrictor 90 dampens out momentary changes or the fluctuations in the vacuum level.

A first spring 92 of small predetermined force $F_1$, such as, for example, equivalent to a pressure of 2" $H_2O$, normally biases diaphragm 70 and disc valve 84 away from the open end of stand pipe 88 to permit air to enter through opening 80 into pipe 88 to decay the vacuum signal in line 60. This will cause chamber 50 of servo 44 to approach ambient air pressure or at a pressure level lower than the force of spring 55, causing EGR valve 42 to be seated to block communication of EGR gases in passage 40 to the intake manifold 22.

Diaphragm 70 is moved vertically in an oscillating manner as a function of the pressure change in chambers 76 and 78. Chamber 76 is connected by an orificed control line 94 to a constant pressure control chamber 96 formed in passage 40. The latter is defined by the EGR valve 42 at one end and a flow restricting orifice 98 at the opposite end.

Completing the construction, lower chamber 78 is connected by an orificed line 102 to the exhaust manifold gases in branch line 40, to be subject to the changing levels of exhaust gas backpressures. These pressures act on the lower side of diaphragm 72 that normally is biased downwardly to the position shown by the force of a spring 106 that is of a greater force $F_2$ than spring 92. That is, it is equivalent to a pressure of approximately 15" $H_2O$, for example, as compared to the 2" $H_2O$ pressure of spring 92. Spring 106 is seated at its upper end against a stationary washer-like reaction member 108. Fixedly secured to diaphragm 72 on its upper side is an abutment member 110 that is adapted to engage the undersurface of diaphragm 70 at times to move with it when the force of spring 106 is overcome by the greater exhaust gas backpressure level in line 102. As indicated, the cross-sectional area of upper diaphragm 70 is made larger than that of lower diaphragm 72 to provide a differential area effective to control movement of the diaphragms in accordance with a predetermined schedule in response to changes in the exhaust gas backpressure levels. Their controlled movement, therefore, will control the bleed of air into EGR servo chamber 50 to thereby control the position of the EGR valve 42 and the flow rate of gases from the exhaust manifold passage 40 into the intake manifold 22 in a desired manner.

In operation, with the engine running, and the throttle valve plate 26 in the position shown indicating engine idle speed operation, air at atmospheric pressure will be present in passage 60 and servo chambers 50 and 74. The force of EGR spring 55 will maintain EGR valve 42 seated and thereby prevent communication of any exhaust gases in passage 40 to the intake manifold 22. This same condition will prevail at engine full or wide open throttle operating conditions since at that time, with the throttle valve plate 26 in vertical position, the manifold vacuum will have decayed to a very low level below the force of EGR spring 55.

During part load operating conditions, when the throttle valve plate 26 is rotated clockwise from the position shown, the vacuum in manifold 22 then will be communicated to passage 60 as a function of rotation of the throttle valve to increase the level of vacuum in servo chamber 50. Simultaneously, since the exhaust gas backpressure increase in passage 40 is essentially directly proportional to the air flow increase through the carburetor induction passage 18, the exhaust gas backpressure level also will slowly and progressively increase. At low exhaust gas backpressure levels, that is, slightly above the force $F_1$ of 2" $H_2O$ pressure of spring 92, spring 92 will be overcome and the upper diaphragm 70 will be moved upwardly to seat disc valve 84 against the open end 86 of standpipe 88. The lower diaphragm 72 will not move at this time since the force $F_2$ of spring 106 is considerably larger, as indicated above, being essentially equivalent to a force of 15" $H_2O$.

Closing off the end of standpipe 88 now terminates the bleed of air into passage 60 and allows the full application of vacuum in servo chamber 50 to progressively move open EGR valve 42 once the force of light spring 55 is overcome. The opening of EGR valve 42 then communicates the negative pressure level in the intake manifold 22 to constant pressure chamber 96 causing a drop in the same and a corresponding drop in chamber 76 of air bleed device 66. This will drop the pressure level in chamber 76 below the force of spring 92, at which time disc valve 84 will move away from the open end 86 of standpipe 88, and again air at ambient pressure will enter the open end and begin to decay the vacuum level in passage 58 in chamber 50 of servo 44. This will cause the EGR valve to move downwardly in an attempt to regulate the pressure level in chamber 96 and 76 to a constant value. The EGR valve and diaphragm 70 will continue to oscillate until the pressure in control chamber 96 becomes constant, as determined solely by the force of spring 92. This condition is reflected in the graphs and formulas shown in FIGS. 2 and 3 wherein the control pressure in chamber 76 is indicated by $P_C$ and the change in exhaust backpressure is indicated by $P_B$. It will be seen that at exhaust backpressure levels below 15" $H_2O$, that the pressure level $P_C$ in chamber 76 and in control chamber 96 will vary solely in the relationship $$P_C=(F_1/A_1),$$

initially gradually rising to the force level of spring 92, that is, 2" $H_2O$, and thereafter remaining constant, as indicated by line C. This constant mode of operation provides a constant percentage rate of flow of EGR gases from the exhaust manifold passage 40 into the intake manifold 22, as indicated by the curve $C_1$ in FIG. 3. The controlled pressure $P_C$ at this time acting over the area $A_1$ of the upper diaphragm 70 will vary solely as a function of the force $F_1$ of spring 92. It will be independent of any changes in the ehxaust gas backpressure level acting against lower diaphragm 72 since the pressure levels are lower than the 15" $H_2O$ level necessary to overcome the force $F_2$ of spring 106.

When the gas pressures in line 102 rise above the 15" $H_2O$ level, further increases in backpressure level thereafter acting on the area $A_2$ will begin moving diaphragm 72 and abutment 110 upwardly until the latter contacts upper diaphragm 70. From this point on, the two diaphragms 70 and 72 will thereafter act as an integral unit upon further increases in exhaust gas backpressure level. The regulating action of air bleed device 66 now will thereafter be controlled not only by the level of control pressure in chamber 96, but also by the pressure level in lower chamber 78, as indicated by the relationship $$P_C = -\frac{A_2}{A_1 - A_2} P_B + \frac{F_1 + F_2}{A_1 - A_2}$$

in FIG. 2. That is, the control pressure $P_C$ in chamber 76 acting against the differential area $A_1-A_2$ of diaphragms 70 and 72 will change to attempt to balance the forces $F_1$ and $F_2$ of springs 92 and 106 opposed by the force of exhaust gas backpressures $P_B$ in chamber 78 acting against the area $A_2$ of lower diaphgram 72. That is, $$P_C(A_1-A_2)=-P_BA_2+(F_1+F_2)$$

Therefore, at this time, the control pressure $P_C$ will vary as a function not only of the changes in control chamber 96 but also the changes in the exhaust manifold line 40. This is reflected in FIG. 2 by the sloping line D changing control pressure $P_C$ from the positive exhaust manifold backpressure level to the greater negative pressure level of intake manifold 22 as the airflow through the carburetor increases with greater throttle valve openings. FIG. 3 indicates this change in percentage rate of flow of EGR gases by the curve D'. What is happening is that as the exhaust gas backpressure levels increase above the force $F_2$ of spring 106 with increased air flow, the two diaphragms 72 and 70 move as a unit upwardly against the open end 86 of standpipe 88 in essentially the same manner as at lower throttle valve openings to block off the bleed of air into servo chamber 50. This causes the EGR valve again to open, changing the pressure level in control chamber 96 and bleed device chamber 76. In this case, however, the diaphragms will oscillate until an equilibrium position of both the diaphragms and EGR valve is obtained at which time the pressure in control chamber 96 again reaches a constant as determined in this case by the higher exhaust backpressure level in line 102. The percentage rate of flow of gases into the intake manifold will then progressively increase upon progressive opening movements of throttle valve 26 until a maximum percentage rate of flow is reached at the maximum pressure differential across orifice 98.

From the above, it will be seen that the invention provides a dual stage of operation consisting of first a constant percentage rate of flow mode of exhaust gases into the intake manifold at low exhaust gas backpressure levels, followed by a variable percentage rate of flow mode at higher exhaust gas backpressure levels. This two-stage mode of operation is accomplished by the use of an air bleed transducer that provides a first stage of operation that is independent of the changes in exhaust gas backpressure level, followed by a second stage of operation that is controlled as a function of changes in the exhaust gas backpressure levels.

While the invention has been shown and described in its preferred embodiment, it will be clear to those skilled in the arts to which it pertains, that many changes and modifications may be made thereto without departing from the scope of the invention.

We claim:

1. A two-stage exhaust gas recirculation (EGR) system for use with an engine having intake and exhaust manifolds, including, an EGR passage connecting the manifolds for recirculating a portion of the exhaust gases into the engine, an air/fuel induction passage having a throttle valve variable movable across the induction passage to control flow therethrough, the induction passage having a pressure sensing port upstream of the edge of the throttle valve in its closed position to expose the port to essentially atmospheric pressure when the throttle valve is closed and progressively to the level of the manifold vacuum as the valve is opened, a spring closed EGR valve movably mounted in the EGR passage, an engine vacuum controlled first servo connected to the pressure sensing port and to the EGR valve to open the same in response to opening movements of the throttle valve, and an air bleed pressure regulating device in the connection between the first servo and port to regulate the level of vacuum applied to the servo, the air bleed device including an air vent and a spring opened bleed valve movably associated with the vent to control communication of air to the same, and second multi-stage servo means operably connected to the bleed valve to regulate movement of the same, the second servo means including first pressure responsive means connected to the bleed valve and responsive to the level of pressure in a constant pressure control chamber defined between the EGR valve and a flow restricting orifice located upstream of the EGR valve to constitute a first pressure regulating stage of movement of the bleed valve and EGR valve below predetermined exhaust manifold pressure levels, and second means movable in response to the pressure of the gases in the exhaust manifold acting thereon above the predetermined exhaust backpressure level to vary the movement of the bleed valve in a second regulatory stage of movement to provide a second regulatory movement of the EGR valve at a rate different than that of the first stage.

2. A system as in claim 1, including means biasing the second means away from the bleed valve at exhaust gas backpressure levels below the predetermined level thereby permitting the first means and control pressure to be the sole means for regulating the vacuum applied to the EGR valve and regulating the rate of flow of gases through the EGR valve.

3. A system as in claim 1, the second servo means including a first diaphragm fixed to the bleed valve and dividing the second servo means into an air chamber and a second chamber subject to the control pressure, the air vent constituting the orificed open end of a vacuum passage connected to the pressure sensing port and to the first servo, the open end being located adjacent the bleed valve for engagement therewith at times to close the end, the end when open communicating with the air chamber, first spring means biasing the bleed valve and diaphragm away from the passage end to decay the vacuum in the first servo permitting movement of the EGR valve towards the closed position to regulate the pressure in the control chamber to a constant control level as determined by the force of the first spring means, the second means constituting a second diaphragm in the second servo means spaced from the first diaphragm and partitioning the second servo means into the second chamber contiguous to one side of the second diaphragm and into an exhaust manifold pressure chamber contiguous to the other side of the second diaphragm for variably moving the second diaphragm towards the first diaphragm as a function of the rise in exhaust manifold pressure level above the predetermined level, and spring means biasing the second diaphragm away from the first diaphragm.

4. A system as in claim 1, the second servo means including a housing having first and second spaced annular flexible diaphragms therein dividing the housing into a first air chamber between the housing and first diaphragm connected to ambient air, and a second chamber between the diaphragms connected to the control pressure chamber, and a third chamber between the second diaphragm and housing connected to the gas pressure in the exhaust manifold, means connecting the bleed valve to the first diaphragm on the first chamber side, a vacuum passage connecting the first servo and pressure sensing port to the first chamber and having an open air vent end, means projecting the open end of the vacuum passage into the first chamber adjacent the bleed valve for cooperation therewith at times to close the open end upon movement of the bleed valve to thereby provide a regulatory movement of the EGR valve, first spring means biasing the bleed valve to an open position away from the end, second spring means biasing the second diaphragm away from the first diaphragm, and means on the second diaphragm engagable with the first diaphragm upon predetermined movement of the second diaphragm by the exhaust manifold pressure, the two diaphragms thereafter being movable as a unit upon further increases in exhaust manifold pressure to regulate the vacuum applied to and the rate of flow of gases through the EGR valve upon increased opening of the throttle valve.

5. A system as in claim 4, the first servo including a housing having a diaphragm partitioning the housing into an ambient air chamber and a vacuum chamber, means connecting the vacuum chamber to the vacuum passage, means connecting the latter diaphragm to the EGR valve, and spring means biasing the latter diaphragm and EGR valve towards a closed EGR valve position.

6. A system as in claim 4, the first spring means being of less force than the second spring means, the control pressure level being constant and independent of exhaust manifold pressure changes during the first stage movement of the EGR valve when the exhaust manifold pressure level is lower than the force of the second spring means thereby providing a first constant percentage rate of flow of gases through the EGR valve, the control pressure varying as a function of the changes in exhaust manifold pressure during the second stage movement of the EGR valve to provide a variable percentage rate of flow of gases through the EGR valve different than the flow rate during the first stage movement.

7. A system as in claim 1, the control pressure level being constant and independent of exhaust manifold pressure level changes during the first stage movement of the EGR valve in response to an exhaust manifold pressure level lower than the force of the second spring means to provide a first constant percentage rate of flow of gases through the EGR valve, the control pressure varying as a function of the changes in exhaust manifold pressure during the second stage movement of the EGR valve to provide a variable percentage rate of flow of gases through the EGR valve in comparison to the flow rate during the first stage movement.

* * * * *